US008025585B2

(12) United States Patent
Kramski

(10) Patent No.: US 8,025,585 B2
(45) Date of Patent: Sep. 27, 2011

(54) POSITIONING DEVICE FOR A GOLFER WHEN PUTTING

(75) Inventor: Wiestaw Kramski, Birkenfeld (DE)

(73) Assignee: Kramski Putter GmbH, Birkenfeld (DE)

( * ) Notice: Subject to any disclaimer, the term of this patent is extended or adjusted under 35 U.S.C. 154(b) by 0 days.

(21) Appl. No.: 12/455,714

(22) Filed: Jun. 5, 2009

(65) Prior Publication Data

US 2009/0305804 A1 Dec. 10, 2009

(30) Foreign Application Priority Data

Jun. 6, 2008 (DE) ..... 10 2008 027 152

(51) Int. Cl.
*A63B 69/36* (2006.01)

(52) U.S. Cl. ..... 473/218; 473/278

(58) Field of Classification Search ..... 473/218, 473/266, 270, 272, 273, 278
See application file for complete search history.

(56) References Cited

U.S. PATENT DOCUMENTS

| | | | | |
|---|---|---|---|---|
| 2,790,642 A | | 4/1957 | Rolfe | |
| 4,699,384 A | | 10/1987 | Bechler et al. | |
| 4,925,192 A | | 5/1990 | Forbes | |
| 5,108,106 A | * | 4/1992 | Cook | 473/272 |
| 5,246,234 A | * | 9/1993 | Zambelli | 473/272 |
| 5,332,211 A | * | 7/1994 | Rife et al. | 473/258 |
| 5,464,220 A | * | 11/1995 | Hansen et al. | 473/218 |
| 5,827,125 A | | 10/1998 | Lee | |
| 6,821,210 B2 | * | 11/2004 | Kallage, Jr. | 473/218 |
| 2003/0190972 A1 | * | 10/2003 | Townsend, II | 473/278 |

FOREIGN PATENT DOCUMENTS

| | | |
|---|---|---|
| DE | 36 26 829 | 2/1988 |
| DE | 201 08 933 | 6/2002 |

OTHER PUBLICATIONS

German Office Action dated Apr. 21, 2009 with English translation of relevant parts.

* cited by examiner

*Primary Examiner* — Nini Legesse
(74) *Attorney, Agent, or Firm* — Collard & Roe, P.C.

(57) ABSTRACT

A positioning device for a golfer when putting has orientation means for orienting the positioning device relative to a target, placement means for predetermining a relative position of the positioning device and a golf ball, and adjustable positioning means for predetermining a standing position of the golfer relative to the positioning device, i.e. relative to the golf ball. The position of the golfer's feet with regard to the golf ball can be reproducibly predetermined or adapted, respectively, using the positioning device.

13 Claims, 3 Drawing Sheets

POSITIONING DEVICE FOR A GOLFER WHEN PUTTING

CROSS REFERENCE TO RELATED APPLICATIONS

Applicant claims priority under 35 U.S.C. §119 of German Application No. 10 2008 027 152.7 filed Jun. 6, 2008.

BACKGROUND OF THE INVENTION

1. Field of the Invention

The invention relates to a positioning device for a golfer when putting.

2. The Prior Art

In order to be able to play a putt in the direction of a target being aimed at, for example a hole, when playing golf, it is generally necessary to hit a golf ball that is oriented accordingly, such as "square" with the striking surface of the putter. However, it must be taken into consideration that the putter, i.e. its striking surface, moves not on a straight swing path but rather on a curved one, because of the swing movement of the player. Accordingly, it is necessary for the player to position himself correctly with regard to the ball when putting. If he stands the wrong way, the ball will go past the target being aimed at, to the side, because of the curved swing path of the club.

Since every player holds and swings the club differently, there are no generally valid correct standing positions relative to the ball. Instead, this must be determined individually for every player, by trial and error. This is often difficult to do, especially for beginners, because there are no corresponding visual reference points on the green. Furthermore, once a correct standing position has been found, it is often not reproducible, particularly by a beginner, and this in turn can have a negative effect on the results of practice and on pleasure in the game.

SUMMARY OF THE INVENTION

It is therefore an object of the invention to provide a positioning device for a golfer when putting that is easy to handle and can be produced cost-advantageously, and makes it possible to reproducibly specify the individual standing position of a golfer when putting.

This task is accomplished by a positioning device for a golfer when putting, that comprises orientation means for orienting the positioning device relative to a target, such as a hole or a break, placement means for predetermining a relative position of the positioning device and a golf ball, and adjustable positioning means for predetermining a standing position of the golfer relative to the positioning device.

The positioning means of the positioning device according to the invention are adjustable and thus allow individual predetermination of the standing position of the golfer relative to a golf ball, if the positioning device and the golf ball were placed relative to one another by the placement means according to the invention. The player can therefore orient the positioning device according to the invention relative to a target by the orientation means, then place the golf ball relative to the positioning device, using the placement means, and finally, assume the standing position relative to the golf ball that is predetermined by the adjustable positioning means, in a reproducible and individualizable manner.

In order to improve the handling and transport of the positioning device according to the invention, in particular, the positioning device can be formed from a flexible material, particularly rubber, and can be rolled up.

The positioning device can be configured in planar and essentially level manner. In particular, the positioning device can assume the form of a mat, which is particularly suitable for being laid out on the green.

For relative placement of the positioning device and a golf ball, another further development of the positioning device according to the invention provides that the placement means comprise a rounded and, in particular, an arc-shaped recess, with which the positioning device can be laid against an outside circumference of a golf ball approximately at a height of 2 mm—essentially corresponding to the material thickness of the positioning device—above the ground, i.e. the green, so that the device is configured for positioning the golf ball. Since the golf ball touches the green only in the region of an area having a relatively small diameter, the recess is also configured in the form of an arc, corresponding to the height, whose related (full circle) diameter, at about 10-12 mm, is clearly smaller than the actual diameter of a golf ball (43 mm).

According to another embodiment of the invention, the positioning means comprise an elongated element that is preferably at least essentially straight, and projects, at least when using the positioning device, to the side out of the main body of this device, and can be positioned in various positions relative to this body. Therefore, if the positioning device and a golf ball were positioned relative to one another, advantageously using the recess described further above, it is possible to predetermine a standing position of the golfer relative to the positioning device, i.e. relative to the golf ball, by positioning the elongated element in one of the positions.

In particular, for this purpose, the golfer will set himself up with his feet on both sides of the elongated element, with his feet each preferably situated at the same distance from the elongated element. In this manner, a clear and reproducible standing position of the golfer relative to the positioning device, i.e., relative to the golf ball, is predetermined.

In another embodiment, the elongated element can be inserted into the main body of the positioning device, projecting to the side, in certain positions, and is held there, particularly in a releasably clamped manner. Alternatively, the elongated element can also be screwed into the positioning device. For this purpose, the main body of the positioning device can have corresponding insertion openings or screw-in openings in the positions, the diameter of which is preferably reduced, in the case of insertion openings, with regard to an insertion or outside diameter of the elongated element, in order to bring about the desired clamping fit.

In one embodiment of the invention, the insertion openings can be disposed in a particular region of the main body that is configured to have a reinforced thickness for this purpose.

Preferably, the insertion openings lie along an (imaginary) first straight line, which extends parallel to a second straight line that is part of the orientation means.

With the special configuration of the positioning device as described above, the elongated element can be adjusted to be parallel to a playing line of the golf ball that is being aimed at, after relative placement of the positioning device and of the golf ball has taken place.

The second straight line serves, independent of the number and arrangement of the insertion openings, for aiming at a target, i.e. for orienting the positioning device. Alternatively or in addition, the second straight line can also serve for orienting the positioning device relative to a marking placed on the golf ball, such as an equator line, or vice versa (for example for orienting the golf ball marking parallel to or as an extension of the second straight line (orientation line)). However, the presence of such a golf ball marking is not necessary.

In order to further facilitate the handling and, in particular, the transport of the positioning device according to the invention, another embodiment provides that at least one other insertion opening for the elongated element is provided in the positioning device, i.e. in its main body, into which opening this element can be inserted in such a manner that when the positioning device formed from a flexible material is rolled up, the element is protected within the rolled-up positioning device. In this manner, the elongated element cannot get lost during transport of the positioning device, nor can it be damaged, for example break.

For attaching the positioning device on the green, the positioning device can have a plurality of perforations, particularly in its corner regions. In this manner, the positioning device can be fixed in place on the green by a number of tees or other corresponding aids.

The positions, i.e. insertion openings for the elongated element can be disposed equidistant from one another. In another embodiment, the insertion openings are disposed around a corresponding zero position, or a corresponding insertion opening is indicated, on both sides of which other positions, i.e. insertion openings for the elongated element are situated. These measures contribute to simpler insertability and reproducibility of an individual standing position of the golfer relative to the positioning device, i.e. relative to the golf ball.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
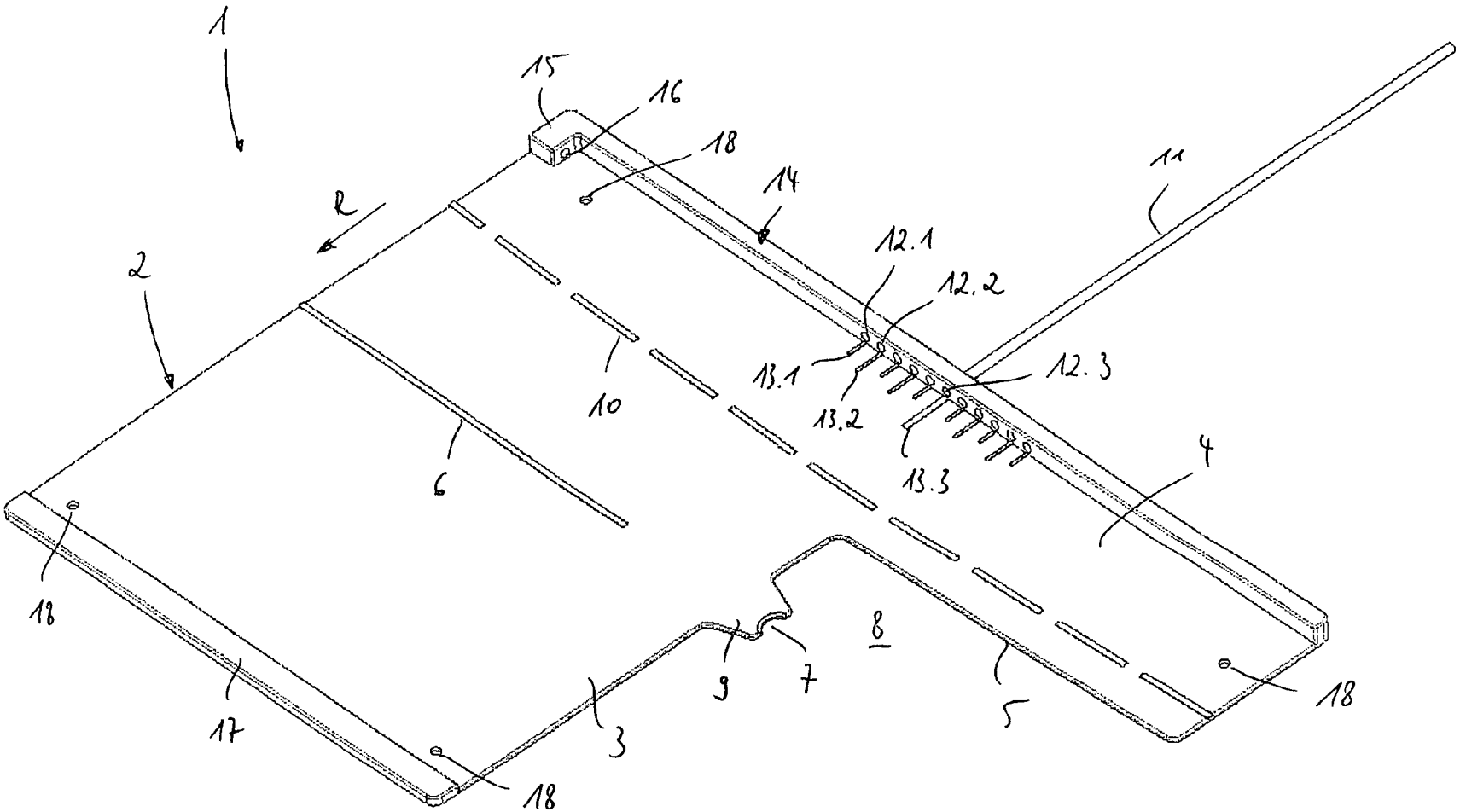
FIG. 1 shows a first perspective view of the positioning device according to the invention.

FIG. 1, in a perspective overall view, shows a positioning device for a golfer when putting, according to the invention, which is designated in its totality with the reference symbol 1. Positioning device 1 comprises a main body 2, which is configured in the form of a mat, from a flexible material, for example rubber, and can accordingly be rolled up. Main body 2 has an essentially L-shaped outline, with a broader first shank 3 and a shank 4 that is narrower relative first shank 3. The borders and edges of main body 2 of positioning device 1, which are not explicitly numbered, for the most part, in the present case, are configured essentially as straight lines and run parallel and at right angles to one another, respectively.

An exception is edge 5 of second shank 4, which faces the shank 3, and has a slight upward curvature, which will be discussed in greater detail below.

Positioning device 1 has orientation means that allow its orientation relative to a target and relative to a golf ball, not shown in FIG. 1, if applicable. The orientation means comprise a straight orientation line 6 for aiming at the target, which has a different color from main body 2 of the positioning device 1, and additionally can be configured to be raised relative to main body 2. Orientation line 6 extends at a right angle to the expanse of first shank 3 of main body 2, and has a reduced length relative to the width of the latter.

Furthermore, positioning device 1 has placement means for relative placement of positioning device 1 and a golf ball. The placement means comprise a rounded, arc-shaped recess 7 (ball positioning recess), which is disposed in region 8 between rounded edge 5 of second shank 4 and first shank 3 of main body 2. Main body 2 of positioning device 1, i.e. its first shank 3, has a projection 9 that extends from first shank 3 of main body 2, into region 8, while narrowing. Recess 7 is disposed at the tip of projection 9; it predetermines the ball position when using the positioning device (see below).

There is a geometric relationship between orientation line 6 and the projection 9, i.e. recess 7, to the effect that an imaginary extension of orientation line 6 runs straight through the center point (not shown) of the full circle that belongs to arc-shaped recess 7.

In the region of second shank 4 and the section of first shank 3 that follows it, main body 2 has another marking line 10 that is also a different color, just like orientation line 6, from main body 2, and in addition can be configured to be raised. In the embodiment according to FIG. 1, marking line 10 is configured to be slightly curved, and the curvature of marking line 10 is adapted to the curvature of edge 5 of second shank 4 of main body 2, which edge has already been mentioned several times, in such a manner that edge 5 and marking line 10 run parallel to one another in this region.

Furthermore, positioning device 1 has adjustable positioning means that serve to predetermine a standing position of the golfer relative to positioning device 1, i.e. to the golf ball not shown in FIG. 1. The positioning means comprise an elongated, rod-shaped and preferably relatively rigid element 11 having a circular cross-section, a number of insertion openings 12.1, 12.2, . . . (cf. FIG. 2), which are disposed in an edge region of main body 2 that has been reinforced in thickness, in the region of the longer edge of second shank 4, and markings 13.1, 13.2, . . . assigned to the insertion openings 12.1, 12.2, . . . , which are configured to be structurally analogous to marking lines 6 and 10. Insertion openings 12.1, 12.2, . . . are disposed parallel to one another, and extend entirely or partly through reinforced edge region 14 of main body 2 (cf. FIG. 2), so that elongated element 11, which is inserted into one of the insertion openings 12.1, 12.2, . . . according to FIG. 1, projects at a right angle to the side, with reference to the corresponding edge 14 of main body 2. Reinforced edge 14 of main body 2 furthermore runs parallel to orientation line 6, or vice versa.

Insertion openings 12.1, 12.2, . . . have an inside diameter that is reduced with regard to the outside diameter of elongated element 11, so that elongated element 11 can be inserted into insertion openings 12.1, 12.2, . . . and is held in a releasably clamped manner there. The minimum dimension of the inside diameter of insertion openings 12.1, 12.2, . . . relative to the outside diameter of elongated element 11 can amount to 3/10 mm, for example, depending on the material.

Insertion openings 12.1, 12.2, . . . are disposed equidistant from one another. Marking lines 13.1, 13.2, . . . can have different lengths, relative to one another, in order to be able to more easily differentiate certain insertion positions visually. In the embodiment shown, positioning device 1 has an odd number of insertion openings 12.1, 12.2, . . . , so that there is a center insertion opening 12.3 that defines a kind of zero location or zero position. The corresponding marking line 13.3 is emphasized, by its length, as compared with all the other marking lines 13.1, 13.2, . . . .

Insertion openings 12.1, 12.2, . . . , as a group, are disposed asymmetrically, particularly offset sideways to the left or—as shown in the figures—to the right relative to recess 7, depending on whether the device is used for right-handed or left-handed players. This means that center insertion opening 12.3 is not at the level of recess 7 when looking at positioning device 1 along the direction predetermined by the expanse of elongated element 11.

As can be seen in FIG. 1, reinforced edge region 14 of main body 2 has a bend 15 at its one end, in the region of second shank 4, which accordingly extends in the running direction of first shank 3. Here, another insertion opening 16 for elongated element 11 is provided in reinforced edge region 14 or 15, respectively, into which elongated element 11 can also be inserted in a releasably clamped manner. When elongated element 11 has been inserted into additional insertion opening 16, it extends essentially parallel to reinforced edge region 14 of main body 2, in the region of or above the mat surface of main body 2. This represents a so-called "parking position" for elongated element 11, since it is then disposed protected within rolled-up positioning device 1 when positioning device 1 is rolled up, for example in the direction of arrow R in FIG. 1.

For reasons of stability and durability, positioning device 1 according to FIG. 1 also has a reinforced edge region 17 at the free end of first shank 3 of main body 2, but in the present case, the thickness reinforcement of this region is less than that of edge region 14.

The entire positioning device 1 can be fixed in place on the green of a golf course by means of golf tees, for example. For this purpose, main body 2 of positioning device 1 has a plurality of perforations 18 that are situated in the corner regions of positioning device 1 and, in particular, in the region of the free end of second shank 4.

Figure 2:
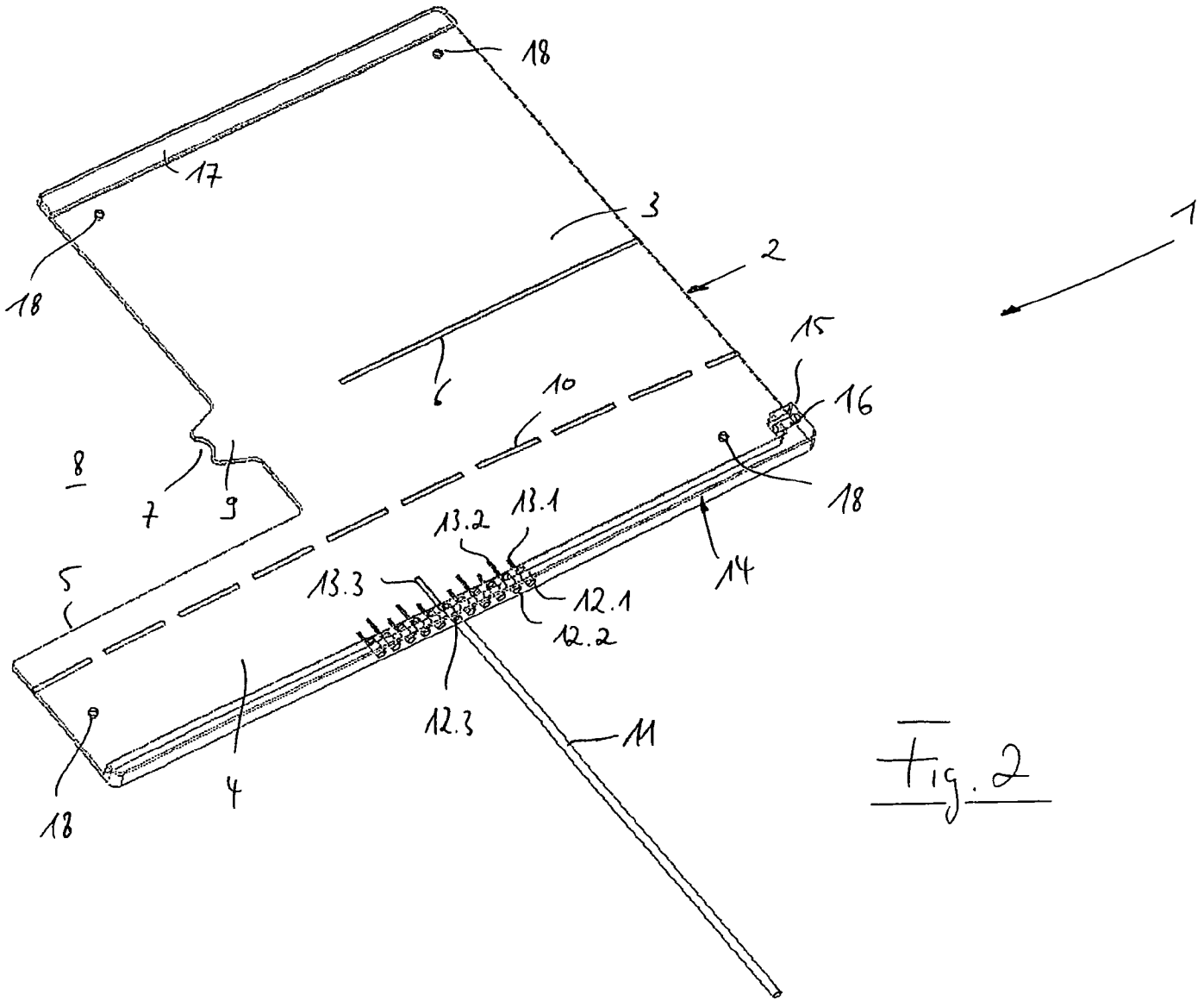
FIG. 2 shows a second perspective view of the positioning device according to the invention.

FIG. 2 once again shows positioning device 1 according to FIG. 1, but in a different perspective representation. Furthermore, positioning device 1 in FIG. 2 is shown to be transparent in the region of reinforced edge 14, 15 of main body 2, in order to once again explicitly illustrate the configuration and the progression of insertion openings 12.1, 12.2, . . . and 16. In particular, the illustration according to FIG. 2 makes the curved progression of marking line 10, as well as the parallel progression of marking line 10 and edge 5 of second shank 4 of positioning device 1, which edge is also curved, clear.

As was true in FIG. 1, elongated element 11 is inserted into center insertion opening 12.3 of positioning device 1 according to representation in FIG. 2, as well.

The intended use of positioning device 1 described above using FIGS. 1 and 2 will now be explained in greater detail with reference to FIG. 3:

Positioning device 1 is laid out onto the green of a golf course, aimed at a target, for example a hole, by means of orientation line 6, and then fixed in place. In this way, it is assured that positioning device 1 is correctly oriented with regard to the target being aimed at, for example a hole. Subsequently, a golf ball 19 is laid against device 1 in the region of recess 7. However, it is also possible, vice versa, to first lay golf ball 19 against the device in the region of the recess 7, in the desired manner, and then to fix positioning device 1 in place on the green, but then there is the risk of moving the ball.

Golf ball 19 can have a corresponding marking 20 along its equator line, at least in part, which marking can already be applied by the manufacturer of golf ball 19, or can be produced afterwards, using a suitable marking means.

In this connection, the relative placement of positioning device 1 and golf ball 19 occurs in such a manner that golf ball 19 lies against the positioning device in recess 7, if possible, so that it continuously touches the edge of recess 7. If possible, orientation line 6 should furthermore align with marking 20 on the golf ball, if such a marking is present.

It is fundamentally also possible to first orient golf ball 19, i.e. its marking line 20, in the direction toward a desired target, particularly using a corresponding orientation aid of the applicant, such as described in German utility model 20 2008 000 861, the disclosure of which is hereby incorporated by reference. However, this is not necessary in the present case, because of the use of orientation line 6 as described above.

Subsequently, when playing (hitting) golf ball 19, putter 21 is preferably guided so that the so-called address position, in which putter 21 strikes golf ball 19, is "square," so that the striking surface of putter 21 is oriented precisely perpendicular, i.e. at an angle of 90°, relative to orientation line 6, and, if applicable, to golf ball marking 20.

For this purpose, putter 21 itself can also have corresponding markings, as shown, but this will not be discussed in any detail here.

Curved marking line 10 as well as curved edge 5 of positioning device 1 symbolize the swing path of putter 21, along which it moves about the body axis of a golfer performing the putt. So that the player hits golf ball 19 "square" despite the curved swing path, the standing location of the player with regard to the ball is of decisive importance, but the standing location to be assumed will be individually different for every golfer.

Figure 3:
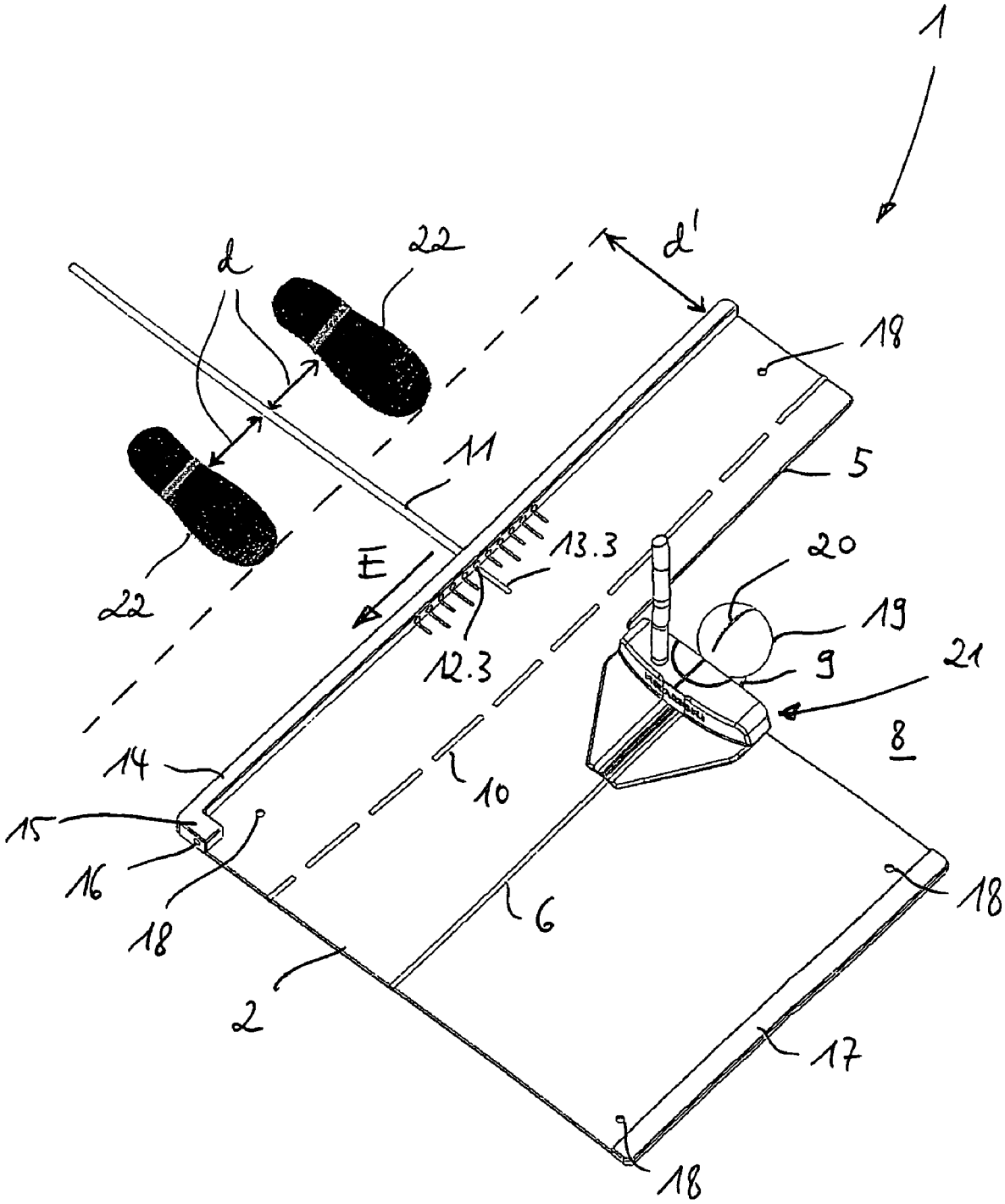
FIG. 3 shows another view of the positioning device according to the invention, in a state oriented relative to a golf ball, with a correspondingly guided golf club (putter).

As is particularly evident from considering FIG. 3, the player will hit ball 19 too early if he stands too far to the left, because of the curved path of the swing movement, so that it will probably roll to the right past the target. If, on the other hand, the player stands too far to the right, he will hit ball 19 too late, and will play it to the left past the target.

Since every player holds and swings club 21 differently, it is necessary to determine or learn the individual standing location ("zero point") of the player relative to ball 19, and the adjustable positioning means of positioning device 1 that has been described are used for this purpose. For this purpose, the player positions himself with his feet 22 on both sides of inserted elongated element 11 and parallel to edge 14, whereby preferably, his two feet 22 are each situated at the same distance d from elongated element 11. Furthermore, feet 22 should be situated at the same distance d' from main body 2 of positioning device 1. Initially, element 11 is preferably in the (center) zero position.

If the player now plays ball 19 at a certain position of elongated element 11 with regard to main body 2 of positioning device 1, he will determine—as described above—whether he reaches the target being aimed at with the device or whether he plays the ball past the target to the right or the left. In the two cases last mentioned, a correction of the player's standing position is required, according to what has been said above, and for this purpose, the position of elongated element 11 with regard to the main body 2 of positioning device 1 is changed—in the present case, by means of inserting the elongated element into a new, adapted insertion opening.

If, for example, the player plays ball 19 to the right past the target being aimed at, he is standing too far to the left and will therefore insert elongated element 11 into an insertion opening that lies farther to the right, from his view, as indicated by the arrow E in FIG. 3. Subsequently, he will change his standing location with regard to elongated element 11 accordingly, in order to thereby hit ball 19 in the desired manner, i.e., later.

If ball 19 is going to the left past the target being aimed at, at first, the player will proceed in the opposite manner, accordingly.

On the basis of markings 13.1, 13.2, . . . that correspond to insertion openings 12.1, 12.2, . . . , in each instance, the player can thus easily remember his individual "zero point" that has been determined in this manner, and can reliably reproduce it during a later training unit.

As a person skilled in the art recognizes, the present invention is by no means restricted to the exemplary embodiment described above as an example. In particular, the adjustable positioning means do not necessarily have to have an elongated element that can be inserted into an insertion opening of the main body of the positioning device. Alternatively, this element can also be configured as an element that can be screwed in, or can be moved along the related edge of the main body in infinitely adjustable manner, which element can either be releasably connected with the main body for transport purposes, or can be folded in against the main body.

Furthermore, additional structures can also be present on the elongated element, preferably in adjustable form, which serve as spacers for the feet of the player with regard to the elongated element and/or the main body of the positioning device, in order to be able to also reproducibly predetermine the distances d, d' in this manner.

Furthermore, in addition to or in place of perforations 18 for fixing the positioning device in place on the green, suitable fixation structures can already be configured integrally with the positioning device, for example on its underside, in order to be able to fix the device in place on the green without any further aids.

Furthermore, recess 7 does not have to be disposed in the region of a projection of the related shank of the positioning device, but rather can be formed directly in the related shank, although providing projection 9 as described facilitates positioning of the device with regard to a golf ball.

Accordingly, while only a few embodiments of the present invention have been shown and described, it is obvious that many changes and modifications may be made thereunto without departing from the spirit and scope of the invention.

What is claimed is:

1. A positioning device for a golfer when putting, comprising:

orientation means for orienting the positioning device relative to a target;

placement means for predetermining a relative position of the positioning device and a golf ball, and adjustable positioning means for predetermining a standing position of the golfer relative to the positioning device;

wherein the positioning means comprise a straight, elongated element, which projects to a side out of a main body of the positioning device, said positioning means adapted to be positioned in various positions relative to this body, and wherein the positioning device has a number of insertion openings for receiving the elongated element, said insertion openings being disposed in a region of the positioning device that has been reinforced in thickness.

2. The positioning device according to claim 1, wherein the positioning device is formed from a flexible material and can be rolled up.

3. The positioning device according to claim 1, wherein the positioning device is configured in a planar and essentially level manner for being laid out on a green.

4. The positioning device according to claim 1, wherein the placement means comprise a rounded, arc-shaped recess, which is configured for positioning a golf ball.

5. The positioning device according to claim 1, wherein the elongated element can be inserted into the main body of the positioning device, projecting to the side, in various positions, and is held in the main body in a releasably clamped manner.

6. The positioning device according to claim 1, wherein the insertion openings are disposed along a first straight line that extends parallel to a second straight line that is part of the orientation means, for orienting the positioning device relative to the target or relative to a marking applied to the golf ball.

7. The positioning device according to claim 6, wherein the second line extends in a direction toward the positioning means.

8. The positioning device according to claim 1, further comprising at least one additional insertion opening for the elongated element provided in the positioning device, and wherein the positioning device is made from a flexible material that can be rolled up, so that when the positioning device is rolled up, the element can be inserted into the additional insertion opening and be protected within the rolled-up positioning device.

9. The positioning device according to claim 1, wherein there are a plurality of perforations in corner regions of the positioning device, for attaching the positioning device to the green.

10. The positioning device according to claim 1, wherein the placement means comprise a rounded, arc-shaped recess, which is configured for positioning a golf ball, and wherein the insertion openings are disposed asymmetrically relative to the recess.

11. The positioning device according to claim 1, wherein the insertion openings are disposed equidistant from one another.

12. The positioning device according to claim 1, wherein the insertion openings are situated on both sides of a marked zero position.

13. A positioning device for a golfer when putting, comprising:

orientation means for orienting the positioning device relative to a target;

placement means for predetermining a relative position of the positioning device and a golf ball, said placement means comprising a rounded, arc-shaped recess, which is configured for positioning a golf ball, and adjustable positioning means for predetermining a standing position of the golfer relative to the positioning device, wherein at least one edge region of the positioning device has a curved marking corresponding to a swing path of a golf club, wherein said edge region or marking is located in a plane of the positioning device, and wherein the adjustable positioning means is configured to allow free positioning of a player's feet relative to the positioning means and parallel to an edge of the positioning device.

* * * * *